US007578637B2

(12) United States Patent
Song

(10) Patent No.: US 7,578,637 B2
(45) Date of Patent: Aug. 25, 2009

(54) PILE WITH AN EXTENDED HEAD AND WORKING METHOD OF ITS OPERATION

(75) Inventor: Yoon-Yong Song, Jeonju-si (KR)

(73) Assignee: Ki-Yong Song, Seoul (KR)

( * ) Notice: Subject to any disclaimer, the term of this patent is extended or adjusted under 35 U.S.C. 154(b) by 244 days.

(21) Appl. No.: 10/526,392

(22) PCT Filed: May 6, 2004

(86) PCT No.: PCT/KR2004/001048

§ 371 (c)(1),
(2), (4) Date: Sep. 20, 2005

(87) PCT Pub. No.: WO2005/090689

PCT Pub. Date: Sep. 29, 2005

(65) Prior Publication Data

US 2006/0104722 A1 May 18, 2006

(30) Foreign Application Priority Data

Mar. 20, 2004 (KR) ..... 10-2004-0019102

(51) Int. Cl.
*E02D 5/22* (2006.01)

(52) U.S. Cl. ..... 405/255; 52/301

(58) Field of Classification Search ..... 405/231, 405/253, 255; 52/301
See application file for complete search history.

(56) References Cited

U.S. PATENT DOCUMENTS

| | | | | | |
|---|---|---|---|---|---|
| 225,061 | A | * | 3/1880 | Johnson | 405/248 |
| 226,237 | A | * | 4/1880 | MacLay | 405/255 |
| 262,569 | A | * | 8/1882 | Case | 405/251 |
| 4,012,915 | A | * | 3/1977 | Poma | 405/243 |
| 5,816,554 | A | * | 10/1998 | McCracken | 248/346.01 |

FOREIGN PATENT DOCUMENTS

| | | | |
|---|---|---|---|
| JP | 2003-138561 | A | 5/2003 |
| JP | 2003-213675 | A | 7/2003 |
| JP | 2003-286720 | A | 10/2003 |

* cited by examiner

*Primary Examiner*—Tara Mayo-Pinnock
(74) *Attorney, Agent, or Firm*—Birch, Stewart, Kolasch and Birch, LLP

(57) ABSTRACT

A head-extended pile for supporting a load of a structure and a constructing method of the same, wherein, the head-extended pile has a reinforcement part provided at the front end thereof, the reinforcement part having a diameter larger than that of the pile so that the front end supporting force of the pile is increased.

3 Claims, 6 Drawing Sheets

Fig. 5
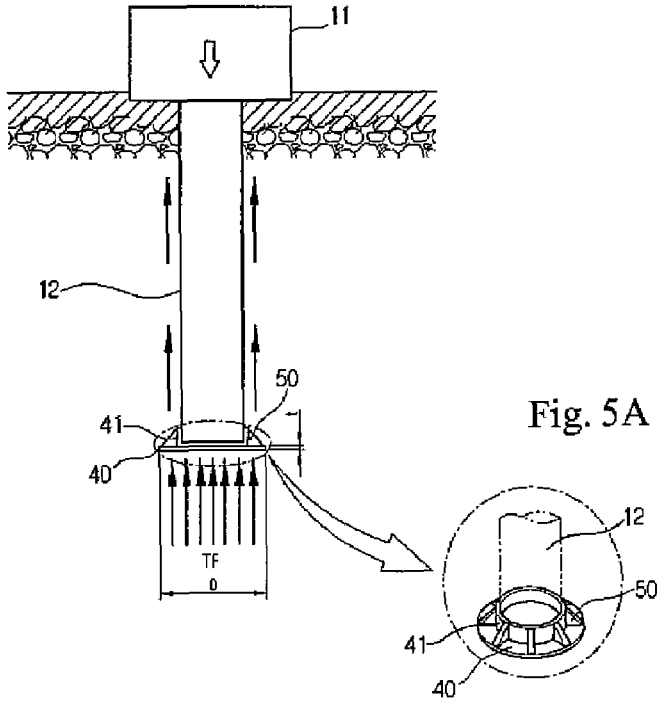
Fig. 5A
Fig. 6
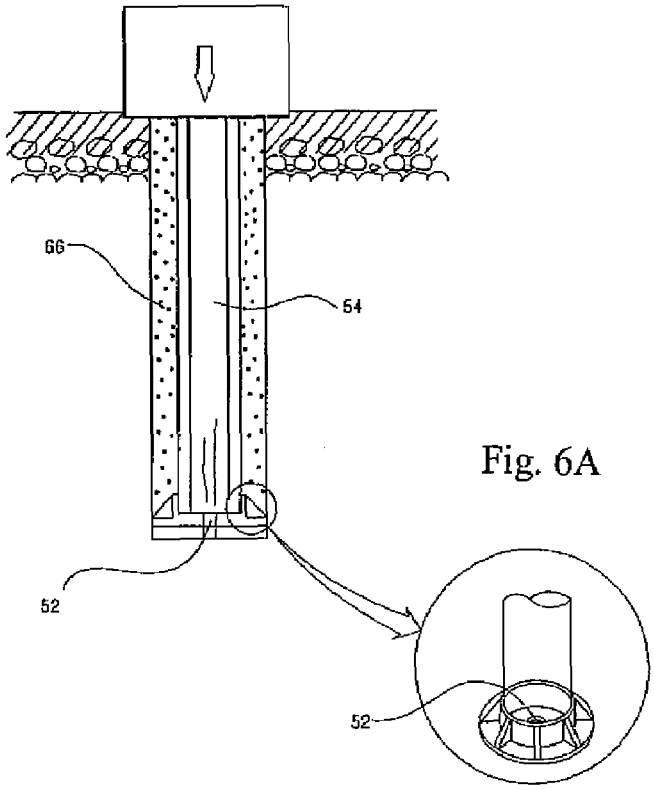
Fig. 6A

Fig. 8A
Fig. 8
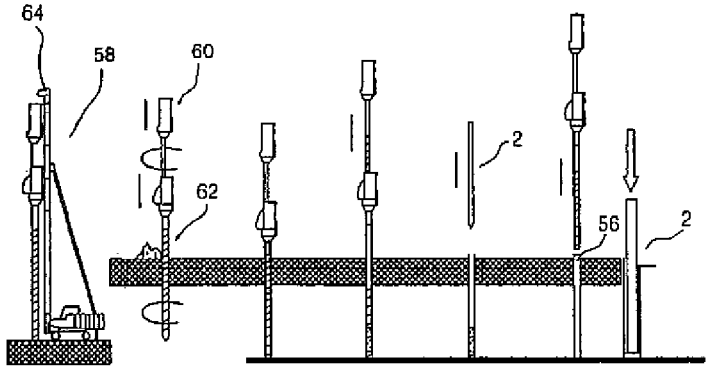
Fig. 9
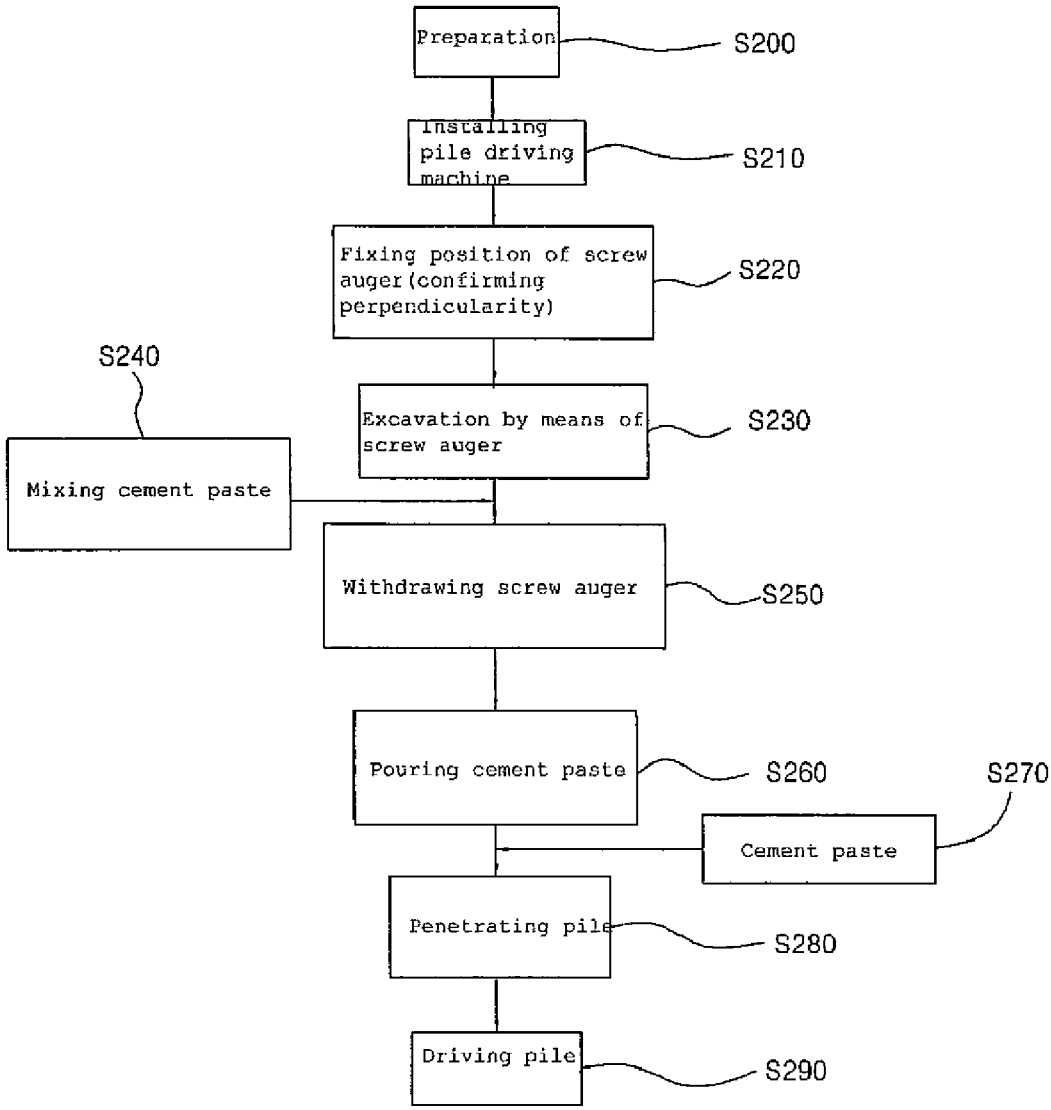

PILE WITH AN EXTENDED HEAD AND WORKING METHOD OF ITS OPERATION

BACKGROUND OF THE INVENTION

1. Technical Field

The present invention relates to a head-extended pile, and more particularly to a head-extended pile having an increased supporting force to support the load of a structure. Also, the present invention relates to a method for constructing such a head-extended pile with stability to proof stress of the pile, construction workability, and economic efficiency.

2. Background Art

When a building or a structure is built, construction of a foundation for reinforcing the ground is generally carried out according to conditions of the ground or the load of the building or the structure so that the building or the structure can be supported on the ground. Construction of a shallow foundation or a deep foundation is carried out based on various conditions, such as load of a structure. The shallow foundation is a foundation having a penetration width ratio below 1 while the deep foundation is a foundation having a penetration width ratio above 1. In the case of the shallow foundation, a structure is directly supported on the ground without using piles. In the case that a structure is not sufficiently supported on the ground, on the other hand, piles are used to reinforce a supporting force of the ground.

A pile foundation system is a foundation system characterized in that heads of the constructed piles are connected to a structure. Piles may be classified into steel piles, concrete piles, and composite piles on the basis of their material. Pile installation methods may be classified into pile driving, pile burying, and in-place casting.

The pile driving is a method characterized in that a pile is erected, and is then forcibly driven into the ground by hammering until the pile is fully penetrated into the ground. When the pile is forcibly penetrated into the ground by means of hammering energy, the pile is penetrated while the pile pushes through the soil around the pile. Consequently, a supporting force of the pile is excellent, and the pile is simply constructed.

However, the pile driving method has a drawback in that it is difficult to penetrate the pile vertically when the pile need to be deeply penetrated into the ground. Also, excessive vibration and noise are generated when the pile driving method is carried out. Consequently, the pile driving method is only limitedly used in urban areas due to certain restrictions.

On the other hand, the auger drilled piling is a method characterized in that a hole is previously bored in the ground, a cement paste is poured halfway into the hole, and then a pile is fixedly inserted into the hole. The auger drilled piling method can solve the drawbacks of the pile driving method. Currently, the pile burying method is mainly used to construct pile foundations in urban areas.

The construction of the foundation is extremely important in the aspect of building the structure. Various pile installation methods are used without consistency on the basis of the personal experience of constructors because conditions of the ground or vary according to site, or vary according to the site, or the operation of the pile-driving machine is not fully understood. As a result, the pile constructing work is not easily carried out.

FIG. 1 is a conceptual drawing showing the relation between an inherent proof stress of a pile and a constructional proof stress of the constructed pile. As shown in FIG. 1, load (PE) of a structure 11 is supported by means of constructional proof stress of a plurality of piles 12 penetrated into the ground below the structure 11. The constructional proof stress of the constructed pile 12 is the sum of a front end bearing force (TF) at the front end of the pile and a surrounding frictional force (SF) at the outer circumference of the pile. Generally, the inherent proof stress of the pile is larger than the constructional proof stress. However, the constructional proof stress of the pile is decreased due to its bad construction workability.

For example, a Φ400 high-strength concrete pile (hereinafter, referred to as "PHC pile") has an inherent proof stress of 112 tf and a constructional proof stress of 60 to 80 tf. As a result, 32 to 52 tf of the inherent proof stress of the pile is wasted. Especially when auger drilled piling method is used, a drilled hole having a diameter larger than that of a pile is bored in the ground, the pile is penetrated into the hole, and cement paste is poured between the pile and the ground in order to increase a surrounding frictional force. However, a test of the pile after the construction is completed reveals that the surrounding frictional force is insignificant and most of the constructional proof stress is the front end bearing force. Consequently, it is necessary to increase the constructional proof stress near the inherent proof stress of the pile in the auger drilled piling method so that efficiency in use of the pile can be improved.

Therefore, the present invention has been made to solve the above problems, and it is an object of the present invention to provide a head-extended pile having an increased constructional proof stress so that the pile can have increased support load for a structure increasing the weight and the volume of the pile used in an auger drilled piling method. Moreover, the efficiency in use of the pile and economic efficiency of the pile are improved. It is also the object of the present invention to provide a method for constructing such a head-extended pile with stability to proof stress of the pile, construction workability, and economic efficiency.

SUMMARY OF THE INVENTION

In accordance with one aspect of the present invention, the above and other objects can be accomplished by the provision of a pile having a reinforcement part attached to or integrally formed with the front end of the pile, the reinforcement part having a prescribed thickness and a diameter slightly larger than that of the pile, so that the front end supporting force of the pile is increased.

The reinforcement part may be formed at one end of the pile or at either end of the pile.

The pile can have an additional conical member or reinforcement wings formed on the reinforcement part.

In accordance with another aspect of the present invention, there is provided a constructing method of a head-extended pile in the ground composed of collapsible soil when the ground is bored, comprising the steps of: selecting a pile, preparing and checking a pile driving operation, and removing obstructions (S10); inspecting the ground to be constructed, reinforcing the ground, and installing a pile-driving machine (S20); checking perpendicularity of a casing or a screw auger and a reader at the front and at the side to fix the position of the casing (S30); confirming a soil layer status where the pile can be driven on the basis of excavation, a geological survey report, used current of an auger motor, the discharged amount of soil, and a trial pile driving operation so that the excavation is carried out by means of the casing and the screw auger (S40); mixing water and cement by means of an exclusive cement mixer (S50); injecting cement paste at high pressure after the screw auger is withdrawn (S60); penetrating the screw auger again to stir the cement paste and treat the slime (S70); slowly withdrawing the screw auger (S80); erecting the head-extended pile so that the head-extended pile is penetrated by means of its own weight (S90); fixing the upper end of the head-extended pile by means of the screw auger (S100); slowly withdrawing the casing after the upper end of the pile is fixed by means of the screw auger (S110); and driving the head-extended pile so that the pile can be penetrated (S120).

In accordance with yet another aspect of the present invention, there is provided a constructing method of a head-extended pile in the ground composed of uncollapsible soil when the ground is bored, comprising the steps of: selecting a pile, preparing and checking a pile driving operation, and removing obstructions (S200); inspecting the ground to be constructed, reinforcing the ground, and installing a pile-driving machine (S210); checking perpendicularity of a screw auger and a reader at the front and at the side to fix the position of the screw auger (S220); checking a soil layer where the pile can be driven on the basis of excavation, a geological survey report, used current of an auger motor, the discharged amount of soil, and a trial pile driving operation so that the excavation is carried out by means of the screw auger (S230); mixing water and cement by means of an exclusive mixer to obtain cement paste (S240); withdrawing the screw auger (S250); injecting the cement paste at high pressure (S260); penetrating the screw auger again to stir the cement paste and treat the slime (S270); erecting the head-extended pile so that the pile is penetrated by means of its own weight (S280); and driving the head-extended pile so that the pile can be penetrated (S290).

Advantageous Effects

According to the present invention, the constructional proof stress of a pile can be increased to near the inherent proof stress of the pile without increasing the weight and the volume of the pile used in a pile burying method. Consequently, the quantity of the piles to be used in a pile burying work is reduced, therefore efficiency in use of the pile and economic efficiency of the pile are improved. Also, the reinforcement part or the reinforcement disk can be attached to a conventional pile in market. Consequently, applicability of the conventional pile is also improved.

A designed proof stress of the pile is generally decided by pile manufacturers in such a manner that the designed proof stress corresponds to the proof stress of the pile decided on the basis of the ground conditions or the construction workability, which is lower than the inherent proof stress of the pile. As a result, the designed proof stress of the pile is reduced by approximately 30 to 40% compared to inherent proof stress. However, 100% of the proof stress can be utilized in the present pile construction method when the head-extended pile according to the present invention is used. As a result, the designed proof stress of the pile is decided so that it can be matched with the inherent proof stress of the pile.

The designed proof stress of the pile can be increased with the result that the quantity of the piles to be used is decreased, which leads to saving the cost and time of construction. Also, the length of the pile can be decreased when the design is completed so that the pile has a relatively small proof stress.

When the head-extended pile is prepared and driven in the same manner as the conventional pile constructing method, and the pile construction is completed at an N value of approximately 50/20~10, a required supporting force is obtained as compared to a pile construction designed in the field.

Consequently, the pile constructing method according to the present invention can guarantee the economic efficiency, safety, and improved construction workability as compared to the conventional pile constructing method.

When the designed proof stress of the pile is small, the length of the pile can be reduced by approximately 20 to 40%. Consequently, cost of construction is reduced.

In the case that the designed proof stress of the pile is increased through the use of the head-extended pile according to the present invention, the number of the piles may be reduced by approximately 30 to 40%.

Also, the size of the pile cap is decreased, and thus the amount of concrete cement and required reinforcing steel is reduced by approximately 10 to 20%. Furthermore, construction time is considerably reduced as the total number of the piles is decreased, and direct material and labor cost, indirect cost, personnel expenses, and financial expenses according to duration, are considerably reduced. Accordingly, the present invention is very useful method for building and civil construction.

BRIEF DESCRIPTION OF THE DRAWINGS

The above and other objects, features and other advantages of the present invention will be more clearly understood from the following detailed description taken in conjunction with the accompanying drawings, in which:

FIG. 5 is a sectional view showing a reinforcement pile having reinforcement wings for supporting the protrusion part of the reinforcement disk shown in FIG. 4;

FIG. 5A is a detailed showing of the reinforcement disk;

FIG. 6 is a sectional view showing a water-discharging hole formed in the reinforcement disk according to the present invention;

FIG. 6A is a detailed showing of the water discharging hole;

FIG. 8 is a sequential view showing a constructing method of a head-extended pile using a casing in the ground having collapsible soil when the ground is bored;

FIG. 8A is a side view of the pile drawing device used in FIG. 8;

FIG. 9 is a flow chart illustrating a constructing method of a head-extended pile in the ground having uncollapsible soil when the ground is bored.

DETAILED DESCRIPTION OF THE INVENTION

Figure 1:
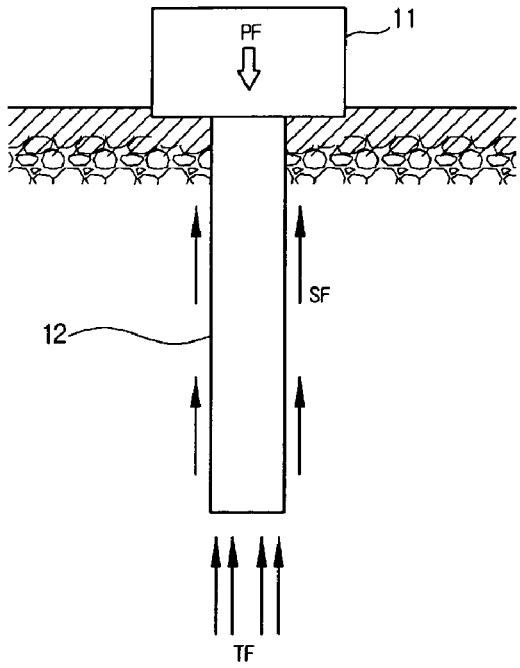
FIG. 1 is a sectional view showing the relation between an inherent proof stress of a pile and a constructional proof stress of the constructed pile.
Figure 2:
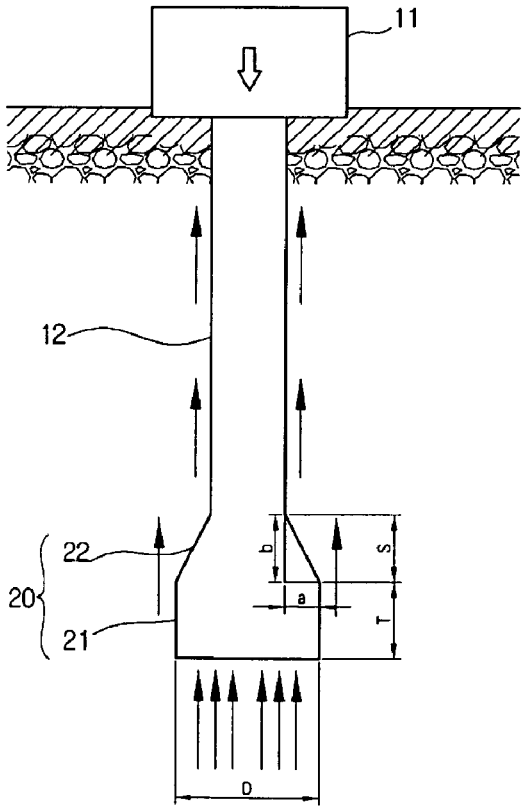
FIG. 2 is a sectional view showing the structure of a reinforcement pile having a reinforcement part provided at one end thereof.

The preferred embodiments of the present invention will be described in detail with reference to the accompanying drawings wherein FIG. 2 is a sectional view showing the structure of a reinforcement pile having a reinforcement part provided at one end thereof As shown in FIG. 2, a head-extended pile 2 comprises a cylindrical pile part 12 and a lower reinforcement part 20. The lower reinforcement part 20 comprises a lower reinforcing member 21 and a tower conical member 22.

The cylindrical pile part 12 has a diameter of 350, 400, 450, 500, or 600 mm, and the cylindrical pile part 12 may be composed of a concrete pile, a PHC pile, a steel tube, a H-type beam, a composite tube, or a wood pile.

The lower reinforcing member 21 may be integrally formed with the lower end of the cylindrical pile part 12 or securely fixed to the lower end of the cylindrical pile part 12 by means of a fixing unit. The lower reinforcing member 21 is a disk-shaped structure of a prescribed thickness. The lower conical member 22 has a prescribed slope surface connected between the end of the cylindrical pile part 12 and the end of the lower reinforcing member 21.

Table 1 shows dimensions and dynamism of the pile.

TABLE 1

| Kind of Pile | Φ 350 PHC | Φ 400 PHC | Φ 450 PHC | Φ 500 PHC |
|---|---|---|---|---|
| Inherent proof stress of pile (tf) | 89 | 112 | 137 | 173 |
| Surrounding frictional force (tf) | 30.37 | 38.13 | 46.76 | 59.04 |
| Front end bearing force (tf) | 58.63 | 73.87 | 90.24 | 113.96 |
| Diameter of conventional pile (mm) | 350 | 400 | 450 | 500 |
| Cross-sectional area of conventional pile ($cm^2$) | 961.625 | 1256 | 1590 | 1963 |
| Appropriate diameter of reinforcement part (mm) | 473 | 531 | 587 | 660 |
| Cross-sectional area of reinforcement part ($cm^2$) | 1759 | 2216 | 2707 | 3419 |

It can be seen from Table 1 that a front end bearing force of 58 tf is necessary to obtain an inherent proof stress of 89 tf in the case of the Φ350 PHC pile. However, a front end bearing force of 58 tf cannot be obtained because the cross-sectional area of the conventional pile having a diameter of 350 mm is 961.625 $cm^2$. Consequently, it is required that a cross-sectional area of the front end of the pile be 1759 $cm^2$ to obtain a front end bearing force of 58 tf. In other words, it is required that the diameter of the reinforcement part be increased to 473 mm.

Referring to Table 1, it is required that the cross-sectional areas of the front ends of Φ400, Φ450, and Φ500 PHC piles be increased to 2216 $cm^2$, 2707 $cm^2$, and 3419 $cm^2$, respectively, to fully utilize the inherent proof stress of the respective piles. To this end, it is required that the diameters of the reinforcement parts of the piles be increased to 531 mm, 587 mm, and 660 mm, respectively.

Preferably, the diameter (D) of the lower reinforcing member 21 is equal to the thickness (T) of the lower reinforcing member 21. The slope ratio of the lower conical member 22, i.e., the ratio of the protrusion width (a) to the slope width (b), is selected within a range of 1:1~10. Preferably, the ratio of the protrusion width (a) to the slope width (b), is 1:6.

Figure 3:
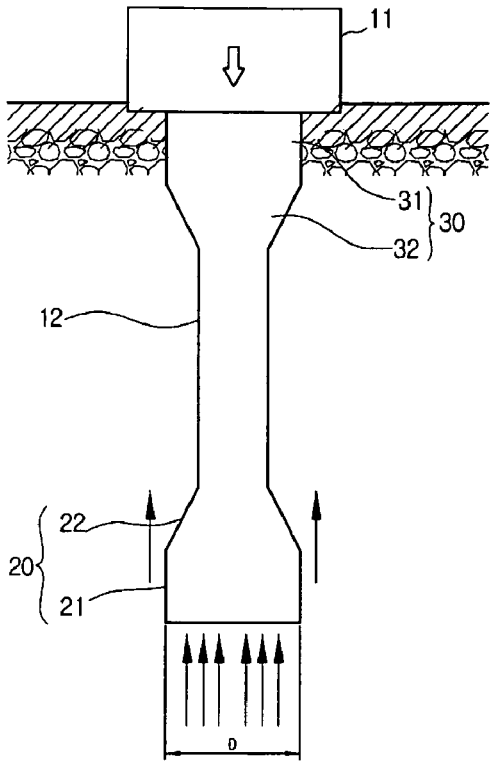
FIG. 3 is a sectional view showing the structure of a reinforcement pile having reinforcement parts provided at both ends thereof.

FIG. 3 is a sectional view showing the structure of a reinforcement pile having reinforcement parts provided at both ends thereof. As shown in FIG. 3, the dual-side reinforcement pile comprises a cylindrical pile part 12, a lower reinforcement part 20 formed at the lower end of the cylindrical pile part 12, and an upper reinforcement part 30 formed at the upper end of the cylindrical pile part 12. The upper reinforcement part 30 comprises an upper reinforcing member 31 and an upper conical member 32 in the same manner as the lower reinforcement part 20 of FIG. 2. Also, the upper reinforcement part 30 has the same shape and size as the lower reinforcement part 20.

Figure 4:
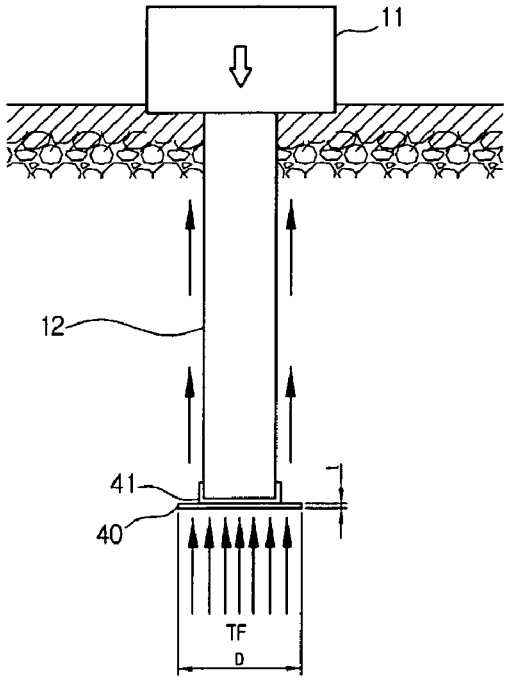
FIG. 4 is a sectional view showing the structure of a reinforcement pile having a reinforcement disk attached to one end of a conventional pile, for example, a pre-tensioned spun high strength concrete (PHC) pile.
Figure 7:
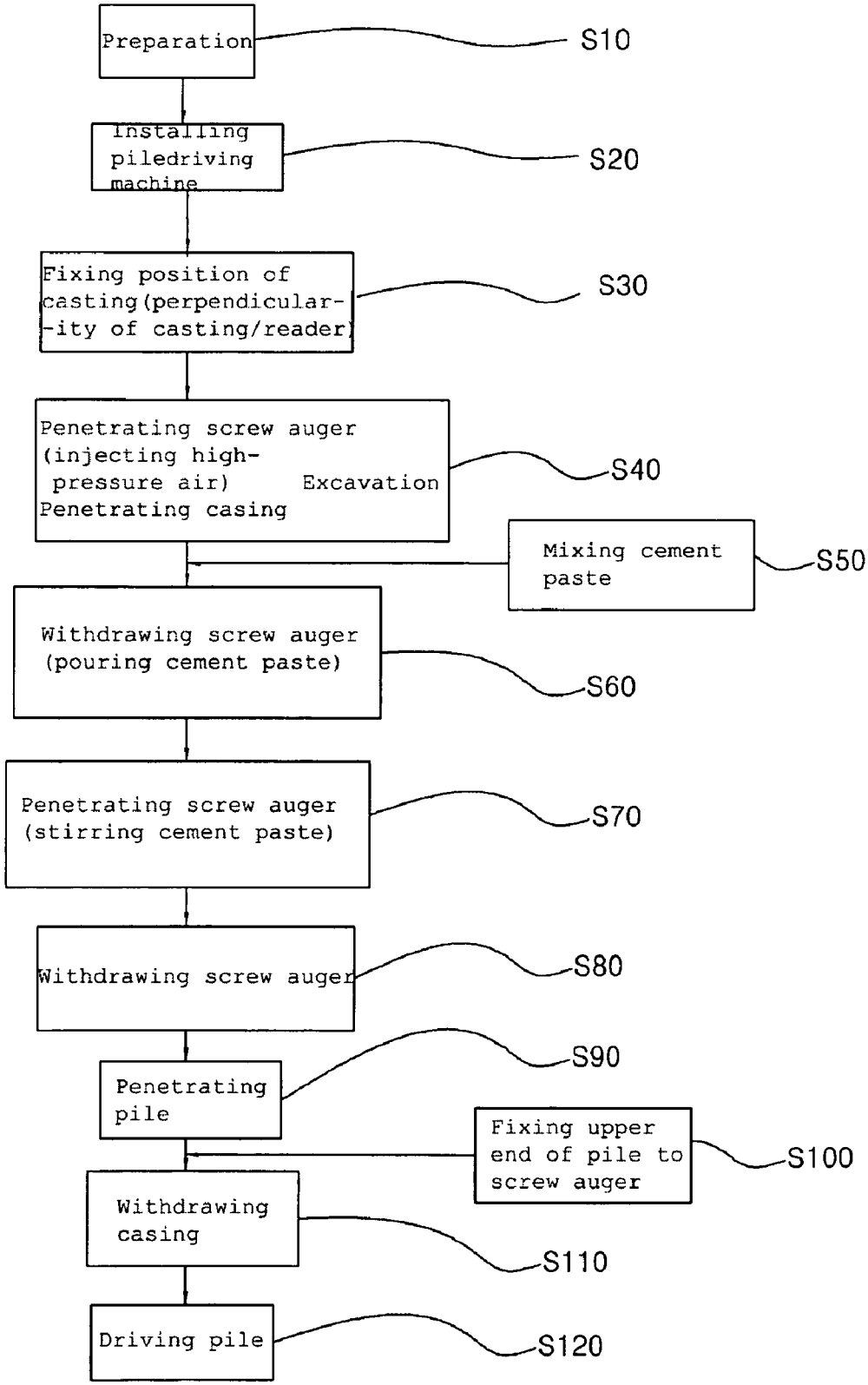
FIG. 7 is a flow chart illustrating a constructing method of a head-extended pile using a casing in the ground having collapsible soil when the ground is bored.
Figure 10:
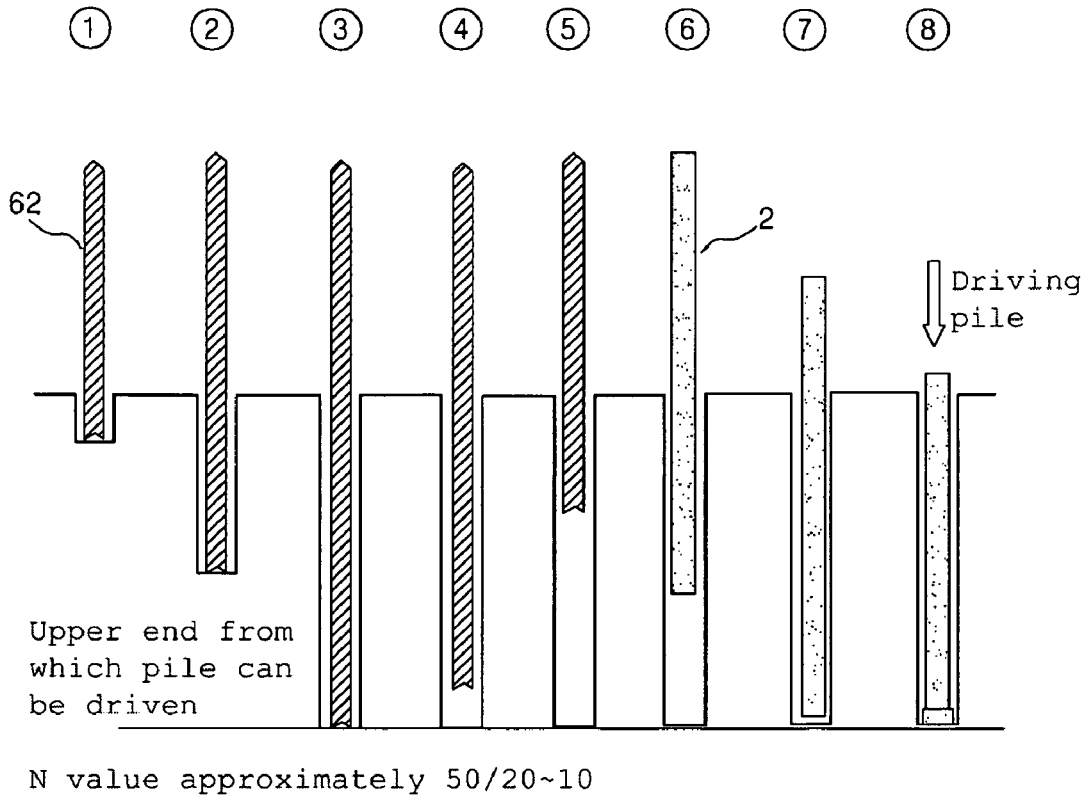
FIG. 10 is a sequence view showing a constructing method of a head-extended pile in the ground having uncollapsible soil when the ground is bored.

FIG. 4 is a sectional view showing the structure of a reinforcement pile having a reinforcement disk attached to one end of a conventional pile, for example, a pre-tensioned spun high strength concrete (PHC) pile. As shown in FIG. 4, the reinforcement pile comprises a cylindrical pile part 12 and a reinforcement disk 40. The cylindrical pile part 12 has a diameter of 350, 400, 450, or 500 mm, and the cylindrical pile part 12 may be composed of a concrete pile, a PHC pile, or a steel tube. The reinforcement disk 40 is made of iron.

The reinforcement disk 40, having a disk-shaped structure of a prescribed thickness, is securely fixed to the lower end of the cylindrical pile part 12 by means of a fixing unit. In the case that the cylindrical pile part 12 is composed of the steel tube, the reinforcement disk 40 can be securely fixed to the lower end of the cylindrical pile part 12 by welding. In the case that the cylindrical pile part 12 is composed of the concrete pile or the PHC pile, on the other hand, the cylindrical pile part 12 is provided at the lower end thereof with an iron disk 41, which surrounds the lower end of the cylindrical pile part 12, and the reinforcement disk 40 can be securely fixed to the iron disk 41 by welding with the result that the reinforcement disk 40 is securely fixed to the cylindrical pile part 12.

Table 2 shows dimensions and dynamism of the pile and the reinforcement disk.

TABLE 2

| Kind of Pile | Φ 350 PHC | Φ 400 PHC | Φ 450 PHC | Φ 500 PHC |
|---|---|---|---|---|
| Inherent proof stress of pile (tf) | 89 | 112 | 137 | 173 |
| Surrounding frictional force (tf) | 30.37 | 38.13 | 46.76 | 59.04 |
| Front end bearing force (tf) | 58.63 | 73.87 | 90.24 | 113.96 |
| Diameter of conventional pile (mm) | 350 | 400 | 450 | 500 |
| Cross-sectional area of conventional pile ($cm^2$) | 961.625 | 1256 | 1590 | 1963 |
| Appropriate diameter of reinforcement disk (mm) | 473 | 531 | 587 | 660 |
| Cross-sectional area of reinforcement disk ($cm^2$) | 1759 | 2216 | 2707 | 3419 |
| Diameter of reinforcement disk (mm) | 123 | 131 | 137 | 160 |
| Compressive stress (σc: tf/$cm^2$) | 0.10 | 0.10 | 0.10 | 0.10 |
| Thickness of reinforcement | 10.8 | 11.1 | 11.3 | 12.2 |

TABLE 2-continued

| Kind of Pile | Φ 350 PHC | Φ 400 PHC | Φ 450 PHC | Φ 500 PHC |
|---|---|---|---|---|
| disk (mm) | | | | |
| Protruded length of reinforcement disk (a: mm) | 62 | 66 | 69 | 80 |

Where σc=3× front end bearing force/cross-sectional area of reinforcement disk

It can be seen from Table 2 that a front end bearing force of 58 tf is necessary to obtain an inherent proof stress of 89 tf in the case of the Φ350 PHC pile. However, a front end bearing force of 58 tf cannot be obtained because the cross-sectional area of the conventional pile having a diameter of 350 mm is 961.625 $cm^2$. Consequently, it is required that a cross-sectional area of the front end of the pile be increased to obtain a front end bearing force of 58 tf. In Table 2, the cross-sectional area of the reinforcement disk is 1759 $cm^2$, the diameter of the reinforcement disk is 473 mm, and the thickness of the reinforcement disk is 10.8 mm.

It can also be seen from Table 2 that the cross-sectional areas of the reinforcement disks are increased to 2216 $cm^2$, 2707 $cm^2$, and 3419 $cm^2$, respectively, to fully utilize the inherent proof stress of the respective piles. Also, the diameters of the reinforcement disks are increased to 531 mm, 587 mm, and 660 mm, respectively. Table 2 reveals that the thickness of the reinforcement disk is increased as the protruded length of the reinforcement disk is increased.

FIG. 5 is a sectional view showing a reinforcement pile having reinforcement wings for supporting the protrusion part of the reinforcement disk shown in FIG. 4. When the protruded length of the reinforcement disk 40 extending outward from the cylindrical pile part 12 is large or the thickness (t) of the reinforcement disk 40 is small, the outer edge of the reinforcement disk 40 may be bent upward.

As a result, the effective cross-sectional area of the reinforcement disk 40 is reduced, and thus the front end bearing force is reduced. In order to prevent this phenomenon, a plurality of reinforcement wings 50 are provided between the reinforcement disk 40 and the cylindrical pile part 12, as shown in FIG.5.

Preferably, each reinforcement wing 50 is a triangular iron plate. The reinforcement wings 50 are disposed on the upper surface of the reinforcement disk 40 while being spaced a prescribed distance from each other in such a manner that the reinforcement wings 50 arranged around the cylindrical pile part 12. The reinforcement wings 50 can be securely fixed to the reinforcement disk 40, for example, by welding because the reinforcement wings 50 and the reinforcement disk 40 are made of iron.

In the case of the PHC pile, the reinforcement wings 50 are securely fixed to the iron disk 41 surrounding the lower end of the cylindrical pile part 12 by welding. In the case of the steel pile, on the other hand, the reinforcement wings 50 are directly fixed to the outer circumference of the steel pile by welding.

The enlarged perspective view of the circle of FIG. 5 shows the shape and connection of the reinforcement wings 50.

Through the center of the reinforcement disk 40 is formed a water-discharging hole 52, by which the head-extended pile 2 is prevented from rising due to seepage of water. The seepage water is introduced into a hollow part 54 defined in the head-extended pile.

A method for constructing the head-extended pile with the above-stated construction according to the present invention will now be described. When a hole is bored in the ground having collapsible weathering belt, a casing 56 is used to prevent the wall of the hole from collapsing. The hole is bored up to the upper end of the soil layer where the pile driving operation of a pile-driving machine 58 can be carried out, and then the pile is driven into the supporting layer.

Consequently, when a hole is bored in the ground having collapsible soil, a head-extended pile 2 suitable to proof stress is selected. In the case of the PHC pile, a front-closed shoe is used. In the ground having a high water level, the water-discharging hole 52 is formed through the center of the reinforcement disk 50 so that the head-extended pile 2 is prevented from rising from the water level in the hole when the head-extended pile 2 is penetrated into the ground by means of its own weight.

The pile-driving machine 58 and other equipment are inspected on the basis of the ground to check whether they are normal or not. After the depth of the bored hole is estimated, marks are indicated on the pile every 50 cm from the upper end of the weathering belt and every 20 cm near the supporting layer.

At this time, the upper end of the weathering belt is established on the basis of an N value of 50/20~10. The trial pile driving method is preferably carried out to estimate the upper end of the weathering belt, although such estimation may be basis of a geological survey report, an RPM value of the machine, or the discharged amount of soil.

The diameter of the casing 56 is preferably 500 mm larger than the diameter of the head-extended pile 2. The safety of the pile-driving machine 58 has a great effect on the construction of the pile. Consequently, perpendicularity of a screw auger 62 when being penetrated affects the pile-driving machine 58 when the pile is driven by means of the pile-driving machine 58. In some cases, an accident may occur when the pile is driven.

Also, the mixing ratio of water to cement is 1:1, and approximately 40 kg of cement is compounded per meter. The mixed cement is transferred at high pressure, and thus relevant equipment, such as a mixer plant, a mix measuring unit, and a compressor, which are not shown in the drawings, are placed in the same place so that the equipment can be easily and conveniently managed. Obstructions on or in the ground are removed.

As described above, the pile is selected, the pile driving operation is prepared and checked, and the obstructions are removed (S10).

When the pile-driving machine 58 is installed (S20), a lining board is laid or stones are spread out to reinforce the ground if the pile-driving machine 58 may tilt or move during the pile driving operation because the ground is soft and weak. In this way, the ground to be constructed is inspected and reinforced, if necessary, before the pile-driving machine 58 is installed (S20).

Perpendicularity of the casing 56, the screw auger 62 and a reader 64 is checked at the front and at the side, and then the position of the casing 56, the screw auger 62 and the reader 64 is fixed (S30).

In order to protect the wall of the bored hole and prevent blockage of the discharging hole, the screw auger 62 is inserted into the casing 56, and then excavation is carried out in such a manner that the screw auger 62 is rotated in the forward direction and the casing 56 is rotated in the reverse direction. The hole is excavated earlier by means of the front end of the screw auger 62 than the casing 56. Slime is discharged by means of high-pressure air supplied from the front end of the screw auger 62.

The casing 56 is penetrated into the ground until the casing 56 reaches a soil layer where the wall of the hole is not collapsible, and the casing 56 is penetrated to an N value of 50/20~10 (near the weathering belt).

The soil layer in the ground where the pile can be driven is checked on the basis of the geological survey report. Also, the soil layer is accurately checked through the preparation of a section of the soil layer of the geological survey lengthwise and breadthwise. The prepared sectional view of the soil layer is compared with the result of the trial pile driving operation to indicate a predictive penetration depth of the pile on the sectional view. In this way, the geological survey report is prepared.

When the pile reaches the soil layer where the pile can be driven, the excavation speed of the screw auger 62 is maintained at a constant speed, and RPM is recorded. The method for checking the soil layer where the pile can be driven by means of the RPM is not accurate due to uncertainty of the soil layer. Consequently, the RPM method is used only for reference in the field. A column diagram is accurately prepared, and then the prepared column diagram is compared to the predictive penetration depth of the pile to check used current of an auger motor.

The soil discharged by means of the screw auger 62 is mixed, and thus the nature of soil cannot be accurately checked. Consequently, the soil layer is estimated through comparison with the geological survey report to check the discharged soil.

The trial pile driving operation is carried out at several places, if possible, considering the field circumstances and the machine penetration conditions to exactly record the status of the soil layer and mark the predictive penetration depth of the pile. In this way, the main pile driving operation is prepared. When the trial pile driving operation is carried out, the operation is carried out at least twice every house, and the operation is carried out within a distance of 30 m in the case of a parking place. Preferably, the trial pile driving operation is carried out as several times as possible.

Also, the result of the trial pile driving operation is indicated on the arrangement view and the sectional view so that the position and the range where the pile can be driven are indicated and thus used in the field. The lower the excavation speed is, the better the result. When the screw auger is rotated in the reverse direction while the excavation is carried out, the soil attached to the screw auger 62 is dropped into the hole. Consequently, it is necessary that the screw auger not be rotated in the reverse direction.

As described above, the soil layer where the pile can be driven is checked on the basis of the excavation, the geological survey report, the used current of the auger motor, the discharged amount of soil, and the trial pile driving operation, and then the excavation is carried out by means of the casing 56 and the screw auger 62 (S40).

The previously prepared cement paste mixer, the compressor, and the generator are placed in the same place. The pouring of material is carried out such that water is poured, and then cement is poured. The front end of the pile is penetrated by means of a subsequent pile driving operation. Consequently, the mixture of cement (40 kg/m) and water in a 1:1 ratio is poured into the bored hole (S50).

After the mixture of the cement and the water, i.e., cement paste 66 is prepared, the casing 56 for protecting the wall of the hole is left as it is until the cement past 66 is poured. The cement paste 66 is injected at high pressure while the screw auger 62 is slowly withdrawn (S60).

After that, the cement paste 66 is mixed with the surrounding soil to increase the surrounding frictional force. Most of the proof stress of the head-extended pile 2 is derived from the front end supporting force. Consequently, the screw auger 62 is penetrated again to stir the cement paste 66 and treat the slime (S70).

At this time, attention is paid to the penetration depth so that the screw auger 62 does not damage the supporting foundation when the screw auger 62 is inserted.

After that, the screw auger 62 is withdrawn again as slowly as possible (S80).

Subsequently, the head-extended pile 2 is erected such that the center of the head-extended pile 2 exactly corresponds to the center of the bored hole, and then the head-extended pile 2 is penetrated by means of its own weight. When the head-extended pile 2 is penetrated, the cement paste 66 may overflow out of the bored hole. In order to prevent this phenomenon, the pile is slowly penetrated (S90).

After the head-extended pile 2 is penetrated, the upper end of the pile is fixed to the front end of the screw auger 62 (S100), and then the casing 56 is slowly withdrawn (S110).

After that, a shock-absorbing member, not shown in the drawings, is placed at the front end of the head-extended pile 2, and then a ram freely drops to penetrate the pile. The final driving operation is carried out while the upper end of the pile is held such that error of the vertical movement of the ram is corrected depending upon the circumstances of the field (S120).

When the pile is driven, attention is paid to perpendicularity and shake of the pile, and destruction of the front end of the pile. When the perpendicularity of the pile is changed while the pile is driven, the pile may be destroyed or the proof stress of the pile affected. Consequently, it is required that the pile be driven while the center of the pile exactly corresponds to the center of the ram.

When it is determined that the pile reaches the predicted level of the supporting layer as the result of the pile driving operation (the average penetration depth per pile driving operation is approximately 5 to 10 mm), the operation of the pile driving machine 58 is stopped for a while, and then a sinking amount recording device is installed. After the sinking amount recording device is installed, the pile driving operation is initiated again to measure the penetration amount and the rebound amount (S130).

Another method for penetrating the head-extended pile into the ground having collapsible soil when the hole is bored will now be described. The pile is selected, the pile driving operation is prepared and checked, and the obstructions are removed (S200). The ground to be constructed is inspected and reinforced, if necessary, and then the pile-driving machine 58 is installed (S210).

Perpendicularity of the screw auger 62 and the reader 64 is checked at the front and at the side, and then the position of the screw auger 62 and the reader 64 is fixed (S220). The soil layer where the pile can be driven is checked on the basis of the excavation, the geological survey report, the used current of the auger motor, the discharged amount of soil, and the trial pile driving operation, and then the excavation is carried out by means of the screw auger 62 (S230).

After that, water and cement are mixed with each other by means of an exclusive mixer (not shown) to obtain cement paste (S240). After the screw auger 62 is withdrawn (S250), the cement paste 66 is injected at high pressure (S260).

The screw auger 62 is penetrated again to stir the cement paste 66 and treat the slime (S270). Subsequently, the head-extended pile 2 is erected, and then the head-extended pile 2 is penetrated by means of its own weight (S280). At this time, the pile is slowly penetrated so that the cement paste 66 does not overflow out of the bored hole.

After that, a shock-absorbing member, not shown in the drawings, is placed at the front end of the head-extended pile 2, and then pile driving operation is carried out. The final driving operation is performed at a height of 2 m to obtain the final sinking amount (S290).

When it is determined that the pile reaches the predicted level of the supporting layer as the result of the pile driving operation (the average penetration depth per pile driving operation is approximately 5 to 10 mm), the operation of the pile driving machine 58 is stopped for a while, and then a sinking amount recording device is installed. After the sinking amount recording device is installed, the pile driving operation is initiated again to measure the penetration amount and the rebound amount, and thus the final sinking amount (S300).

Those skilled in the art will appreciate that any constructing method using the head-extended pile according to the present invention falls into the scope of the invention irrespective of whether the method is applied to the ground having collapsible soil when the ground is bored or the method is applied to the ground having uncollapsible soil when the ground is bored.

For example, a constructing method of the head-extended pile wherein the head-extended pile is directly driven so that the pile is penetrated, a constructing method of the head-extended pile wherein the head-extended pile is inserted and then directly driven or securely located after the excavation is finished, a constructing method of the head-extended pile wherein the head-extended pile is directly penetrated while the head-extended pile is inserted in any one of a steel tube, a concrete tube, a synthetic resin tube, and a wood tube, and a constructing method of the head-extended pile wherein the head-extended pile is penetrated through the use of hydraulic pressure, pneumatic pressure, or pressure generated by chemical means, all fall under the scope of the present invention.

The invention claimed is:

1. A head-extended pile for supporting the load of a structure, wherein the pile has a cylindrical pile part, a reinforcement member provided at the lower or front end of the pile and a reinforcing member provided at the upper or rear end of the pile, the reinforcement members having a diameter larger than that of the pile whereby the front and rear end supporting force of the pile is increased, said reinforcement members vertically extending from opposite ends of the pile, said reinforcing members having respective lowermost and uppermost portions with a larger dimension than that of the pile and a transitional portion which extends from the outer circumference of the pile to said lowermost and uppermost portions, said transitional portion having a configuration which comprises a plurality of triangular reinforcing wings disposed around the pile while being spaced a prescribed distance from each other wherein the reinforcing members are integral or fixedly attached to the pile, and wherein said reinforcement members further comprise:

an iron disk having a prescribed depth and an inner diameter equal to the diameter of the cylindrical pile part;

a reinforcing disk attached to the iron disk, the reinforcing disk having a diameter larger than that of the iron disk; and said reinforcing wings being attached to the outer circumference of the iron disk and to the upper surface of the reinforcing disk, wherein the reinforcing disk has a water-discharging hole formed through the center of the reinforcing disk.

2. The head-extended pile of claim 1, wherein the pile is a solid concrete pile or a steel pile.

3. The head-extended pile or claim 1, wherein the diameter of the lower reinforcing member is equal to the thickness of the lower reinforcing member and the slope ratio transitional portion is within the range of 1:1 to 1:10.

* * * * *